US005078425A

United States Patent [19]

Crudo

[11] Patent Number: 5,078,425

[45] Date of Patent: Jan. 7, 1992

[54] CASE WITH PRESSURE SENSITIVE ADHESIVE COVERED SPINE STRIP

[75] Inventor: Phillip M. Crudo, Sparks, Nev.

[73] Assignee: VeloBind, Inc., Fremont, Calif.

[21] Appl. No.: 550,323

[22] Filed: Jul. 9, 1990

Related U.S. Application Data

[60] Division of Ser. No. 528,333, May 23, 1990, Pat. No. 5,044,857, which is a continuation of Ser. No. 237,318, Aug. 29, 1988, abandoned.

[51] Int. Cl.[5] ..... B42D 3/00

[52] U.S. Cl. ..... 281/21.1; 281/29; 281/15.1

[58] Field of Search ..... 281/21.1, 29, 15.1

[56] References Cited

U.S. PATENT DOCUMENTS

| | | | |
|---|---|---|---|
| 3,730,560 | 5/1973 | Abildgaard et al. | 281/29 |
| 3,749,422 | 7/1973 | Abildgaard et al. | 281/21.1 |
| 3,834,739 | 9/1974 | Abildgaard et al. | 281/21.1 |
| 3,912,304 | 10/1975 | Abildgaard et al. | 281/21.1 |

*Primary Examiner*—P. W. Echols
*Assistant Examiner*—David P. Bryant
*Attorney, Agent, or Firm*—Julian Caplan

[57] ABSTRACT

The apparatus and case are used with a core formed of sheets and end sheets covered on their exteriors with pressure sensitive material initially protected by release paper all bound togehter by narrow plastic binding strips along the spine edges of the core. The novel case for such a core has a spine having a strip of material covered by pressure sensitive adhesive of a width substantially greater than the thickness of the core plus twice the width of the binding strips, the same strip preferably being glued or otherwise permanently affixed to the spine of the case and extending outward to the inner edges of Davey board cover stiffeners (if used). The apparatus has right and left horizontal platens movable in and out relative to the center. The case is placed on the platens and centered. The core is held in a pivotable clamp behind the platens and is pivoted down so that the spine edge of the core is firmly attached to the spine strip of the case and continued pivoting depresses the spine of the case to the extent that the core binding strips are below the platens. The platens are then brought inward, attaching the spine strip to the end sheets. The book is rolled between rollers which engage above the plastic binding strips and below the Davey boards, thus completing firm attachment of the case to the core.

5 Claims, 3 Drawing Sheets

CASE WITH PRESSURE SENSITIVE ADHESIVE COVERED SPINE STRIP

This is a division, of application Ser. No. 528,333 filed May 23, 1990, now U.S. Pat. No. 5,044,857, which was a continuation of Ser. No. 237,318 filed Aug. 29, 1988, now abandoned.

BACKGROUND OF THE INVENTION

1. Field of the Invention

This invention relates to the production of cased books formed with cores of apertured sheets and end sheets bound together by thin, narrow plastic binding strips. The core is cased in a case which has a wide pressure-sensitive strip extending from the middle of the spine out preferably to the inner edge of the Davey boards used to stiffen the covers. The preferred apparatus for casing the book is characterized by two features, one being that when the spine edge of the core is pivotted down to contact with the pressure-sensitive spine strip, the spine area is depressed below the surface of the platens which support the case, whereupon the platens are moved inward, crimping the pressure-sensitive strip against the end sheets considerably more effectively than in prior constructions of this general type. A second feature of the apparatus is the provision of means for rolling a crease into the side of the book immediately inward of the Davey boards and outwardly of the plastic binding strips which secure the core.

2. Reference to Related Art

Casing-in machines of this general type are illustrated in U.S. Pat. Nos. 3,825,963 and 3,825,964, as well as U.S. Pat. No. Des. 236,373. The present invention comprises an improvement on such machines.

Additionally, since the issuance of the aforesaid patents, improvements have been made on the commercial machines sold prior to the present invention. For example, an adjustment knob for moving the platens which support the case inward and outward has been located on the side of the machine and means for moving the platens inward and outward has also been changed. The present invention incorporates some of these modifications.

Case constructions of the prior art are illustrated in U.S. Pat. No. 3,859,963, as well as U.S. Pat. Nos. 3,730,566, and 4,570,351. In general, the improvement of the present invention relates to the spine area. No foam padding behind the pressure-sensitive adhesive is employed in accordance with the present invention, but the pressure-sensitive adhesive is adhered directly to the inside of the spine cover of the book. The pressure-sensitive strip used with the present invention is considerably wider than those heretofore employed so that, not only does the spine strip cover the spine of the core and the plastic binding strips thereof, but also extends outward to the area of the core outside the spine area and preferably to the inner edge of the Davey board used to stiffen the cover of the case. In those instances where a stiffener such as Davey board is not used, the spine strip is preferably equally wide. Thus as a practical rule of thumb, the pressure-sensitive spine strip is approximately 1½ inches wider than the spine of the core with which it is to be used.

End sheets used with the present invention are shown in U.S. Pat. Nos. 3,749,422 and 3,749,423. The end sheets are bound along with the sheets of the book into the core by the use of plastic binding strips such as those shown in FIG. 1 of U.S. Pat. No. 4,369,013. It will be understood that other binding strips may be used. The end sheets are covered with pressure-sensitive adhesive on their outer faces and are protected initially by release paper. One of the features of the present invention is the fact that the pressure-sensitive spine strip is caused firmly to adhere to the end sheets so that a superior binding is achieved.

SUMMARY OF THE INVENTION

A core comprising the sheets of the book, end sheets and plastic binding strips which bind the core together are well known in the art and the core of the present invention does not differ to any substantial degree from that previously known. It will be understood that other binding strips and other end sheet structures may be substituted for those now commercially available within the scope of the present invention.

The case of the present invention is illustrated herein as having hard covers. However, it will be understood that by eliminating the Davey board stiffeners which are herein illustrated and described, a soft cover may be used. The case has a flexible spine area of a width substantially greater than the width of the spine of the core so that the spine area of the case extends around the spine edges of the front and back covers of the completed book. In accordance with the present invention a strip of thin material having a pressure-sensitive coating is adhered (by pressure-sensitive adhesive or other means) to the spine area of the cover. The pressure-sensitive strip is wider than those previously used in this art, preferably extending outward to the edges of the Davey board (where used) or a corresponding distance (i.e., the strip is approximately 1½ in. wider than the thickness of the core) if stiffeners are not used. The strip is substantially greater than the thickness of the core including the thickness of the binding strips plus twice the width of the binding strips. Preferably the present invention employs no resilient pad underneath the adhesive strip.

Apparatus used in accordance with the present invention is, as has been noted, a modification of a commercially available casing-in machine. The apparatus has a horizontal frame which supports two platens which are movable inward and outward toward the center line of the frame and which support the case. The inner edges of the platens are separated by a gap which equals the thickness of the core and below the platens in the region of the center line the apparatus is unobstructed for a distance for a purpose which hereinafter appears. A clamp for the core is pivotted to the back of the frame so that the core may be pivotted forwardly and down against the case. Located on the machine are a pair of rollers, at least one of which is spring-biased toward the other to form the creases on the sides of the book immediately outward of the spine edges of the core after initial assembly.

In operation, the case is placed on the platens and centered by moving the platens inward and outward. The pressure-sensitive adhesive in the spine of the case is exposed by removing the release paper which initially protects it. The book core is placed in the clamp and held therein. Thereupon the core is pivotted downward, depressing the spine of the case so that the binding strips of the core are below the level of the platens. This operation affixes the spine edge of the core to the center of the plastic spine strip of the case. The platens are then moved together, forcing the pressure-sensitive adhesive strip of the case against the end sheets of the core immediately outward of the plastic binding strips. The result is a superior bind in view of the tight adherence of the case to the core in this critical area. The end sheet release papers are removed and the core is attached to the Davey board of the case. Thereupon the book is pushed endwise between rollers to form a deep, wide crease in the covers resulting in firm attachment of the pressure-sensitive strip of the case to the end sheets of the core in the area immediately outside the plastic binding strips and inside the edges of the Davey board.

A superior book is obtained in that the gap at the inside edges of the end sheets which occurs in prior constructions is eliminated. In other words, there is firm adherence of the case to the core not only at the spine edges but around the edges of the covers closest to the spine.

This firm adherence permits the cover to be bent all the way back without damage to the book. As a matter of fact, the adherence of the crease in the cover to the core functions as a hinge.

Another advantage of the invention is the fact that the book lies flat when opened.

Still another feature of the invention is the fact that there is no "squeaky" noise when the book is opened, this being a result of the elimination of the foam pad which has previously been used in cased book constructions.

Still a further feature of the invention is the fact that no hot melt attachment of the case to the core is required. This eliminates heating the adhesive and thus makes for faster production.

On the whole, in accordance with the present invention it is less expensive to manufacture a book than in prior constructions and a superior bind is achieved.

Other objects of the present invention will become apparent upon reading the following specification and referring to the accompanying drawings in which similar characters of reference represent corresponding parts in each of the several views.

IN THE DRAWINGS

DESCRIPTION OF PREFERRED EMBODIMENTS

Figure 1:
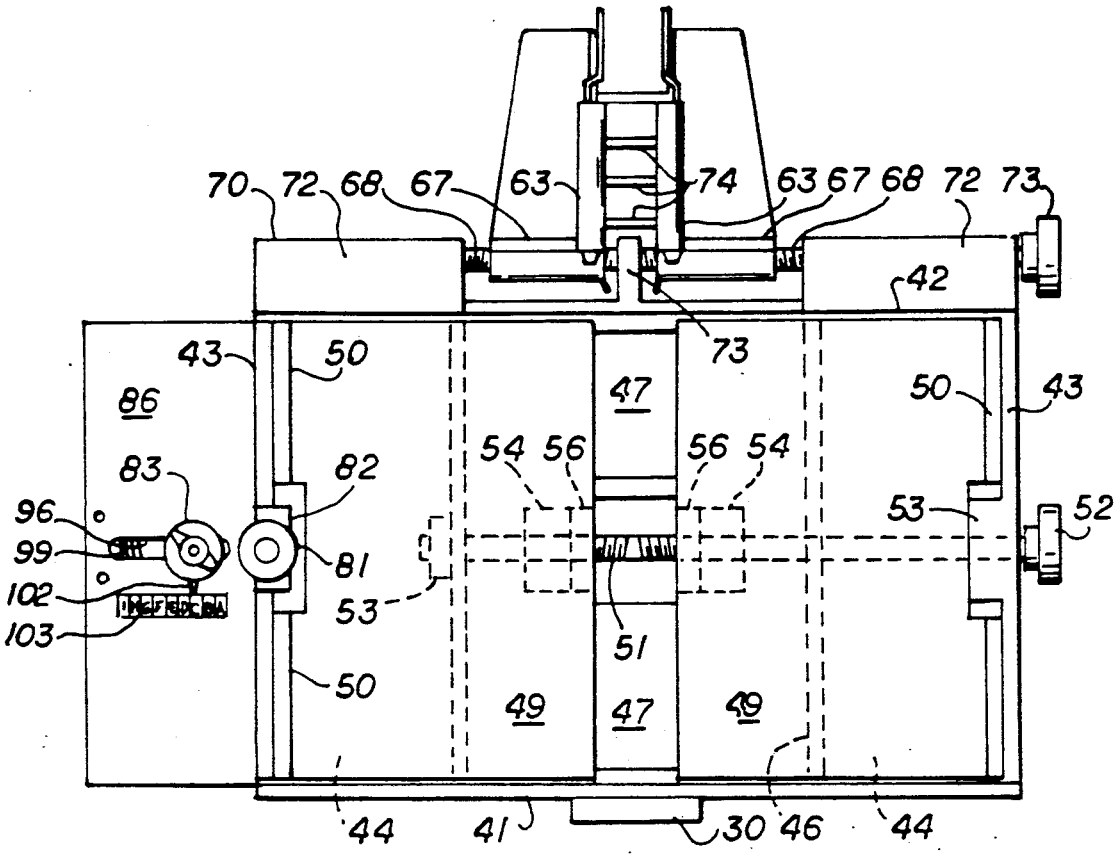
FIG. 1 is a top plan view partially broken away in section.
Figure 2:
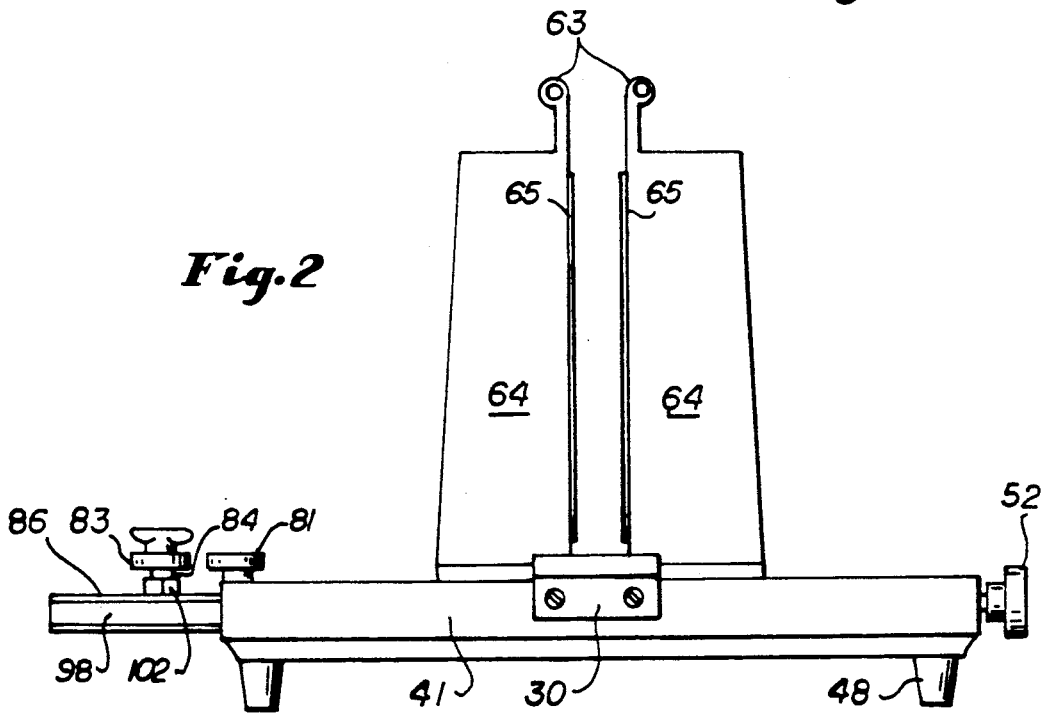
FIG. 2 is a front elevational view.

Case 21 has front and back covers 22, preferably reinforced by Davey board stiffeners 23 affixed to the insides thereof, the top, bottom and outer edges of the cover being turned in to conceal the edges of the Davey board. It will be understood that the use of stiffeners is optional. The front and back covers 22 are joined together by the spine cover 24 preferably integral therewith.

In accordance with the present invention, a spine strip 26 is affixed to the inside of the spine cover 24 by any suitable means such as the use of pressure-sensitive adhesive on the reverse side of the spine strip. Strip 26 has pressure-sensitive adhesive on its outer face which is initially protected by release paper 27.

Core 31 is formed in accordance with the prior art. Thus a plurality of sheets 32 are provided. On the outside of the front and back of the core are end sheets 33, the outer surfaces of which are provided with pressure-sensitive adhesive initially protected by release paper 34. The end sheets as well as the book sheets 32 are formed with longitudinally spaced apart holes formed located slightly inward from the spine edges thereof. First and second plastic binding strips 36 and 37 secure the sheets 22 and end sheets 33 together. Preferably one such binding strip has studs (not shown) projecting therefrom spaced at the same intervals as the holes in the sheets 32 and the other strip has holes at the same intervals as the studs. The studs of one binding strip 36, 37 pass through the holes in the end sheets 33, book sheets 32 and the holes in the opposite binding strip, are cut off and fixed to the opposite binding strip. The purpose of the present invention is to bind the core 31 in a case 21.

The preferred embodiment apparatus comprises a horizontally disposed frame having a front edge 41, a rear edge 42 and side edges 43. Horizontal supports 44 which support the platens (hereinafter described) are located adjacent the edges 43 with a gap 46 in the center between the supports 44. Front and rear bridges 47 span the gap between the supports 44 but at a level below that of the upper surface of the supports 44. The entire frame is preferably supported above a table top by legs 48.

Horizontally slidable inwardly and outwardly on either side of the machine are platens 49 having outside locating edges 50. Movement of the platens 49 is controlled by horizontal transverse platen adjustment screw 51 which has a left hand thread on one side and a right hand thread on the opposite side. Screw 51 is turned by knob 52 shown on the right hand side of the machine in the present embodiment. On the bottom of the frame are bearings 53 which hold the screw 51 in position. Adjacent the inner edge of each platen 49 on the underside thereof is a nut 54 which mates with the screw 51. In accordance with the present invention a notch 56 is formed in the upper inner edge of each said nut 54.

Clamp 61 is pivotted to the back of the machine and comprises sides 62 which engage the front and back of the core having handles 63 at the top. The sides 63 have transverse feet 64 on their front edges and backs 66 on the back. Each of the sides 62 has a nut 67 which mates with a horizontal transverse clamp adjusting screw 68 behind the back edge 42 of the frame. Center bearing 73 extends back from the middle of rear edge 42 to receive the screw 68 and there are also screw guides 72 extending back from each side. Knob 73 on the right end of screw 68 is used to turn the screw 68, it being understood that one side of the screw is formed with a left hand thread and the other with a right hand thread and that the nuts 67 engage therewith. Guide rods 74 hold the sides 62 in parallel, relation, one end of each rod being fixed to one side 62 and sliding through a bore (not shown) in the opposite side 62. Thus the side 62 may be moved toward and away from each other to clamp a core 31 placed therebetween. In accordance with the present invention, to prevent displacement of the core 31, stops 76 engage the edge of the core opposite the spine thereof.

At a convenient place on the apparatus (here shown to be the left side) there are a horizontally disposed vertical axis inner roller 81 supported by a pedestal 82 and an outer roller 83 having a shaft 84 which fits through one of the holes 87 on extension plate 86. The shaft 84 is inserted through the proper hole 87 depending upon the thickness of the book being formed.

In operation of the apparatus, initially a case 21 is placed on the platens 49 with the spine pad 26 and Davey boards 23 uppermost. Knob 52 is turned so that the edges 50 center the case 21. The release paper 27 is then removed, exposing the strip 26.

Knob 73 is turned so that the spacing between the sides 62 will accommodate the core 31. The stops 76 are adjusted so that they engage the outer edge of the core 31 in such a position as to locate the spine edge of core 31 substantially forward of feet 64 (see FIG. 3). Knob 73 is then turned so that the sides 62 securely clamp the outsides of the core 31 (i.e. the release paper 34).

Figure 3:
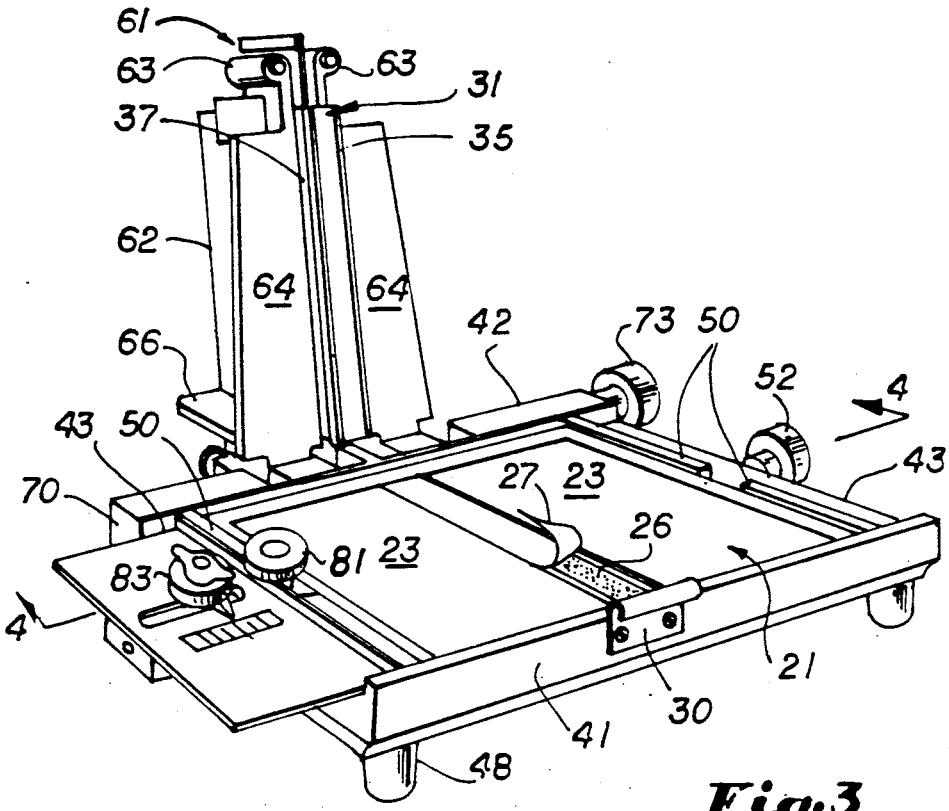
FIG. 3 is a perspective view showing a case in position on the platens and the core in the clamp, the latter being in raised position.
Figure 4:
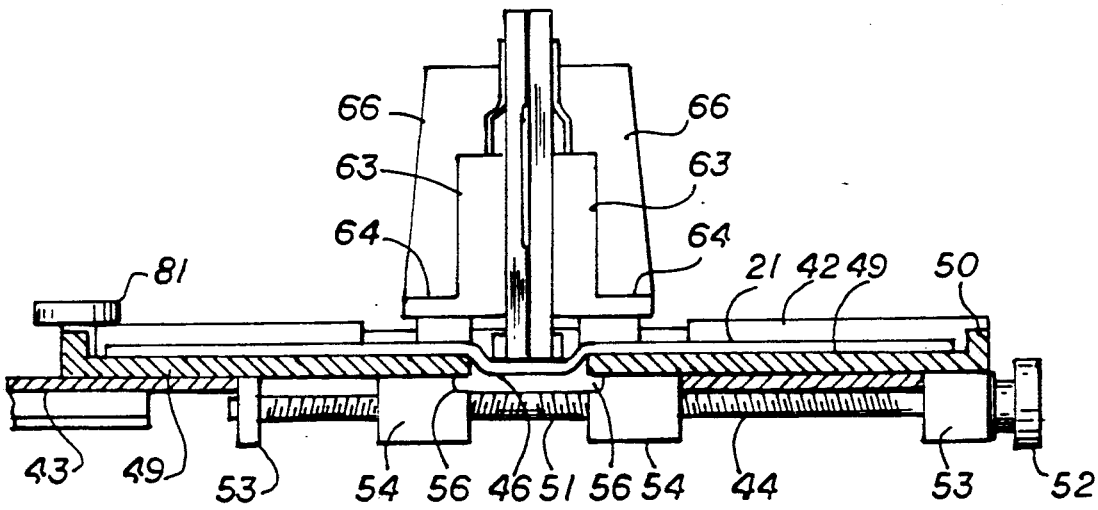
FIG. 4 is a sectional view taken substantially along the line 4—4 of FIG. 3 showing the core partially depressed against the case.
Figure 5:
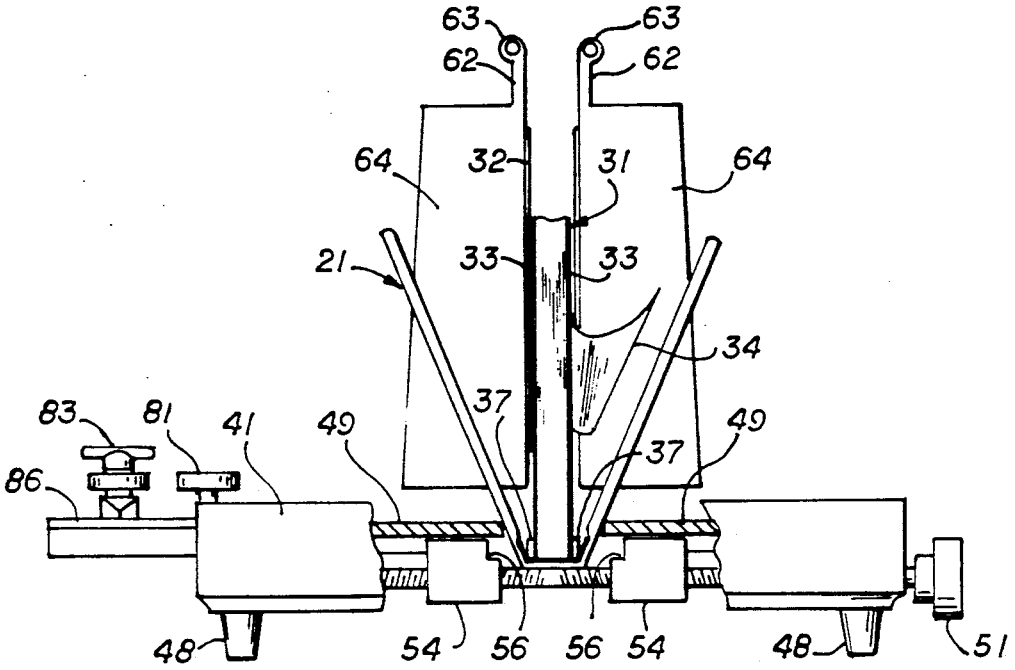
FIG. 5 is a view similar to FIG. 4 showing the core fully depressed.

Clamp 61 is then pivotted forwardly from the position of FIG. 3 to the position of FIG. 4, causing the spine edge of core 31 to contact the pressure-sensitive spine strip 69. Because the center of the machine is unobstructed down to the level of the bridges 47, the spine 24 is depressed until the upper edges of the plastic binding strips 36, 37 are below the lower surfaces of the platens 49 (see FIG. 5). Knob 51 is then turned, bringing the inner edges of the platens 49 toward the core 31, crimping the book 91 into a crease 92 immediately outside of the strips 36, 37.

Knob 73 is then turned to loosen the grip of clamp 61 on the core 31 and the clamp is then swung back to retracted position. Thereupon the covers 22 of the book are folded apart sufficiently to remove the release paper 34 and expose the pressure-sensitive adhesive on the end sheets 33. When the covers are then closed, the pressure-sensitive adhesive on end sheets 33 causes firm adherence of the core 31 to the insides of the covers and, in the preferred embodiment, to the inside of the Davey board 23. The adherence of the core to the pressure-sensitive strip 26 retains the core in place.

Figure 6:
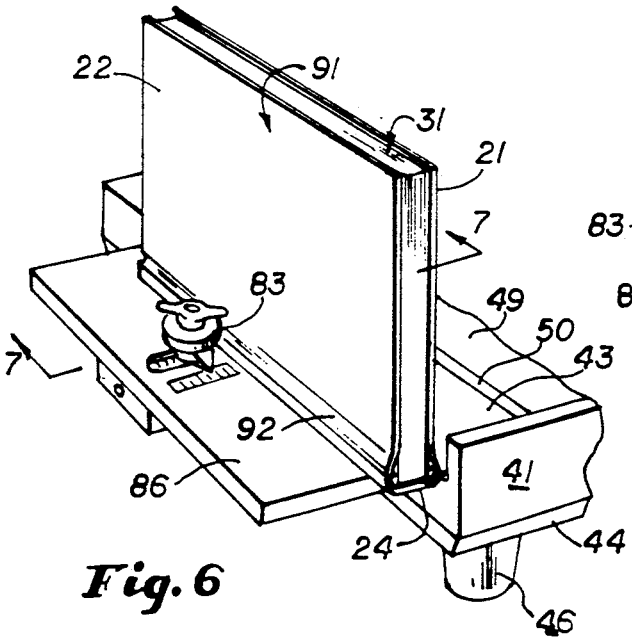
FIG. 6 is a perspective view showing the operation of rolling the casebook to form a crease.
Figure 7:
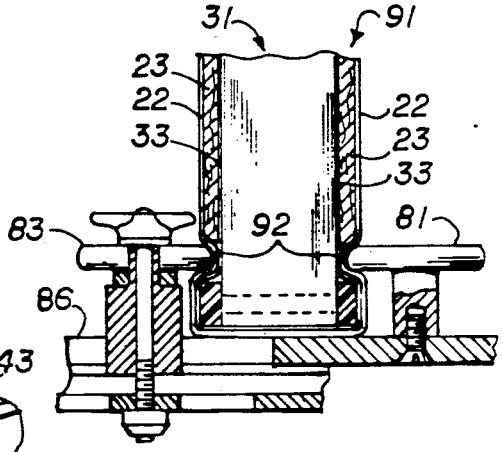
FIG. 7 is a sectional view taken substantially along the line 7—7 of FIG. 6.

The knob 51 is turned to unclamp the book. The book is then moved endwise between the rollers 81 and 83 (see FIGS. 6 and 7) causing a crease 92 to be formed immediately outside the spine strips 36, 37 and inside the inner edges of the Davey board 23.

It will be understood that if soft cover cases are employed (i.e., not using Davey boards 23 or equivalent), the apparatus will readily adapt to form an equally effective bind of the core to the case.

What is claimed is:

1. A case for a core of the type having a spine edge, said core being formed of a plurality of sheets bound together along the spine edge by means of narrow, thin binding strips located on opposite sides of said core along the spine edge thereof, said case comprising front and back covers and an interconnecting flexible spine area substantially wider than the thickness of said core, a spine strip affixed to said spine area having pressure-sensitive adhesive on its outer surface covering a width substantially greater than said spine edge plus twice the thickness and twice the width of one of said binding strips.

2. A case according to claim 1 which further comprises stiffeners on the insides of said covers having inner edges, said spine strip extending outwardly approximately to said inner edges of said stiffeners.

3. A cased book comprising a core of the type having a spine edge, said core being formed of a plurality of sheets bound together along the spine edge by means of narrow, thin binding strips located on opposite sides of said core along the spine edge thereof and a case having front and back covers and an interconnecting flexible spine area substantially wider than the thickness of said core, a spine strip affixed to the middle of said spine area having pressure-sensitive adhesive on its outer surface covering a width substantially greater than said spine edge plus twice the width of one of said binding strips plus twice the thickness of one of said binding strips, the spine edge of said core being attached to the middle of said spine strip by said pressure sensitive adhesive, said spine area being bent around the outsides of said binding strips and attached thereto by said pressure-sensitive adhesive, said spine area being formed with creases immediately outside said binding strips and said creases being firmly attached to the outsides of said core by said pressure sensitive adhesive, said core being attached to the insides of said covers immediately outwardly of said creases.

4. A book according to claim 3 in which said core is formed with end sheets having second pressure-sensitive adhesive on their outer surfaces, said end sheets being attached to said insides of said covers by said second pressure-sensitive adhesive.

5. A book according to claim 4 in which the insides of said covers are provided with stiffeners fixed thereto, said stiffeners being attached to said end sheets by said second pressure-sensitive adhesive.

* * * * *